United States Patent [19]

Steinecker

[11] 4,089,755

[45] May 16, 1978

[54] ACID BRIGHT ZINC PLATING

[75] Inventor: Carl P. Steinecker, Westland, Mich.

[73] Assignee: The Richardson Company, Des Plaines, Ill.

[21] Appl. No.: 814,337

[22] Filed: Jul. 11, 1977

[51] Int. Cl.[2] ..... C25D 3/22

[52] U.S. Cl. ..... 204/55 R

[58] Field of Search ..... 204/55 R, 55 Y, 114, 204/43 Z, DIG. 2

[56] References Cited

U.S. PATENT DOCUMENTS

| | | | |
|---|---|---|---|
| 3,723,263 | 3/1973 | Rosenberg | 204/55 R |
| 3,855,085 | 12/1974 | Rushmere | 204/55 R |
| 3,928,149 | 12/1975 | Steeg | 204/55 R |
| 4,014,761 | 3/1977 | Passal | 204/55 R |

*Primary Examiner*—G. L. Kaplan

*Attorney, Agent, or Firm*—Lockwood, Dewey, Zickert & Alex

[57] ABSTRACT

Acid electroplating baths for bright zinc plating containing a zinc salt, ammonium chloride and bath additives which include a carrier component comprising an alkyl substituted ammonium propoxylate salt, preferably a trialkylammonium propoxylate salt, and a lower molecular weight alkyl substituted naphthalene sulfonic acid, or bath soluble salt thereof, in combination with other brighteners and grain refiners for providing bright, ductile, fine grained, adherent deposits over a broad current density range.

14 Claims, No Drawings

ACID BRIGHT ZINC PLATING

BACKGROUND AND DESCRIPTION OF THE INVENTION

The present invention generally relates to a composition and method for electroplating zinc and, more particularly, to improved acqueous acidic zinc plating bath compositions which provide bright, adherent and ductile zinc electrodeposits. In this regard, an important embodiment of the present invention is directed to the electroplating of zinc from mildly acidic electrolytic baths that contain additives which include a novel carrier component together with other brighteners and grain refiners which cooperate to provide bright, ductile, fine grained, adherent deposits over a broad current density range.

The increasing concern for preserving and restoring the integrity of water supplies as well as the enactment and enforcement of various environmental protection laws has made it desirable to develop non-polluting zinc electroplating processes. As a result, extensive emphasis and effort has been devoted to developing non-cyanide, bright zinc electroplating processes. One approach to this problem has involved the utilization of alkaline solutions containing alkali metal pyrophosphates in combination with complexed zinc compounds. The use of such phosphates, however, has created disposal problems since these phosphate compositions are difficult to remove from aqueous wastes, particularly when they are present in the concentrations required to achieve commercially satisfactory plating processes. Furthermore, electroplating zinc processes employing pyrophosphate baths can result in relatively poor low current density coverage, roughness, insufficient brightness and non-uniform deposts.

Cyanide-free, highly acid, sulfate systems have also been used for zinc plating. These systems, however, are characterized by relatively poor coverage and, as such, are not suited for a wide variety of commercial applications. As a result, these highly acid, sulfate systems have been primarily restricted to the strip line plating of wire and sheets.

More recently, mildly acidic, non-cyanide zinc plating baths have been developed. The waste solutions remaining with such baths can be treated without difficulty to meet existing discharge regulations. The heretofore available mildly acidic zinc baths, however, frequently suffer from one or more of a variety of problems, among which are inadequate brightness, inferior ductility, poor to moderate throwing power, the formation of a coarse crystal structure and, in some instances, the requirement that heat be supplied to the plating bath for optimum use.

In operating such mildly acidic zinc plating systems, certain additives are required to obtain bright plate over a commercially operable range of current densities, thus permitting flexibility in plating, especially in the plating of objects with complex or irregular surface configurations. As such, these additives can be characterized as falling into three general categories, which can be identified as primary type additives or carriers, secondary type additives or brighteners, and auxiliary additives. The primary type additives are present in the bath in higher concentrations than the secondary type or auxiliary additives and generally function to provide grain refining and throwing power. Certain of these primary type additives also have hydrotropic properties which function to keep the secondary type additives or brighteners in solution. The secondary type additives generally function in the bath to provide luster or brightness to the deposit and, in some instances, also provide improved throwing power. The auxiliary additives, among other things, are intended to widen the brightness range and may also assist in solubilizing the secondary additives as well as act as wetting agents. It will, of course, be appreciated that individual additives may, to a greater or lesser extent, in accordance with bath conditions function in more than one of the above described capacities, particularly if used in excess quantities. Commercial requirements, however, will usually necessitate that additive systems for use in mildly acidic zinc plating include components that can be classified into each of the three above defined categories.

The present invention provides a mildly acidic, non-cyanide zinc plating additive system and method which overcomes problems and disadvantages of the prior art systems described above through the use of a novel and improved primary additive or carrier component which comprises an alkyl substituted ammonium propoxylate salt and a lower molecular weight alkyl naphthalene sulfonic acid, or bath soluble salt thereof, in combination with other brighteners and grain refiners. In this regard, an important embodiment of the present invention is directed to the conjoint use of a trialkylammonium proxylate salt and a mixture of sodium mono- and dimethyl- naphthalene sulfonates together with other brighteners and grain refiners for producing bright, ductile, fine grained, adherent deposits over a broad current density range in mildly acidic zinc plating baths.

It is, therefore, a general object of this invention to provide an improved acid, zinc electroplating bath which provides bright, ductile, fine grained, adherent deposits over a broad current density range.

Another object of the present invention is to provide a mildly acidic, zinc electroplating bath composition and method which utilizes an improved primary additive or carrier component that, in combination with other brighteners and grain refiners, provides bright, ductile, fine grained, adherent deposits over a broad current density range.

Another object of the present invention is to provide a mildly acidic, zinc electroplating bath composition and method which utilizes an alkyl substituted ammonium proxylate salt, preferably a trialkylammonium propoxylate salt, and a lower molecular weight alkylated naphthalene sulfonic acid or bath soluble salt thereof, preferably a mono- or dimethyl- naphthalene sulfonate sodium salt, in a carrier component of an additive composition which, in combination with other brighteners and grain refiners, cooperates therewith to provide bright, ductile, fine grained, adherent deposits over a broad current density range.

These and other objects of the present invention will be apparent from the following further detailed description thereof.

In important aspect of the present invention concerns the discovery that bright, fine grain zinc deposits over a broad current density range can be produced in an aqueous bath having a pH of from 4.0 to 6.5 and comprising from 20 to 100 grams per liter of zinc salt; from 100 to 200 grams per liter of ammonium chloride; from about 0.5 to about 20 grams per liter of a primary additive or carrier component which comprises a cationic quaternary ammonium surfactant of the formula

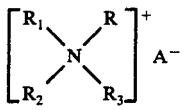

wherein R, $R_1$ and $R_3$ are lower alkyl radicals, $R_2$ is a polyoxypropylene radical and A is selected from the group consisting of halogen, sulfate and sulfamate, said ammonium surfactant having a molecular weight of from 500 to 3000, and a low molecular weight alkyl naphthalene sulfonic acid or water soluble salt thereof, such as, for example, the mono- and dialkyl substituted naphthalene sulfonic acids or naphthalene sulfononates where the alkyl groups contain from 1 to 4 carbon atoms, together with from about 0.05 to about 5.0 grams per liter of one or more secondary additives and auxiliary additives.

While the quaternary ammonium surfactants of this invention are generally known compositions of matter, their use for electroplating compositions is novel and, as such, constitutes an important aspect of the present invention. In this regard, it will be appreciated by those skilled in this art that individual compositions consistent with the generic description of these quaternary ammonium surfactants can be readily obtained as articles of commerce.

In a preferred embodiment of the present invention, the substituents of the quaternary ammonium surfactant are more specifically defined in that R is methyl and $R_1$ and $R_3$ are each ethyl. Moreover, a particularly efficacious surfactant is

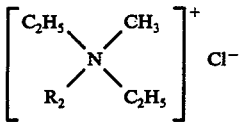

wherein $R_2$ is a polyoxypropylene radical such that the molecular weight of the surfactant is about 600. Other well suited surfactants have the same general structural formula except that they possess a molecular weight of from about 1600 to about 2500.

The preferred alkyl substituted naphthalene sulfonic acids and water soluble salts thereof are the mono and diloweralkyl substituted naphthalene sulfonic acids and water soluble salts thereof wherein the alkyl groups contain 1 or 2 carbon atoms. In this regard, sodium methyl naphthalene sulfonate and sodium dimethyl naphthalene sulfonate, and mixtures thereof, are particularly preferred for use in the acid zinc plating systems of the present invention.

The zinc electroplating baths of this invention utilizing the aforedescribed quaternary ammonium surfactants and alkylated naphthalene sulfonates contain as a source of zinc ion a water soluble zinc salt. Exemplary useful zinc salts for the plating baths of this invention include zinc chloride, zinc sulfate, zinc acetate and zinc fluroborate, with zinc chloride being the most often used zinc salt because of its wide availability and economy.

The concentration of zinc salt in the plating bath of this invention can vary widely. Generally an amount of from 20 to 150 grams per liter is desirable with an amount of from 30 to 100 grams per liter being preferred. At concentrations much above those generally described, the electroplated deposit tends to become semi-bright to matte gray. Similarly, at concentrations much below those generally described the deposit becomes semi-bright.

As previously indicated, the electroplating baths of this invention also contain ammonium chloride. The amount of ammonium chloride used in the bath is essentially dependent on the concentration of zinc salt present. Generally, however, the concentration of ammonium chloride should substantially exceed that of the zinc salt in the bath. Accordingly, an amount of from 100 to 200 grams per liter can be suitably used in the electroplating baths of this invention with amounts of from 120 to 185 grams per liter being preferred. In instances wherein ammonium chloride concentrations in the bath are significantly below these amounts, semi-matte deposits can result. Moreover, where concentrations of zinc salts higher than those specified above are used, a corresponding proportionate increase in the ammonium chloride concentrate should be utilized.

As previously mentioned the cationic quaterary ammonium surfactant and alkylated naphthalene sulfonic acid or water soluble salt thereof used in the electroplating baths of this invention are part of a primary additive or carrier component. This component may also contain a variety of additional individual materials which principally function as primary additives or carriers to impart improved grain refining and throwing power properties to the bath. These additional optional additives in the primary additive or carrier component include polyvinylpyrrolidone, naphthalene sulfonate and formaldehyde condensation products, alkyl phenol and ethylene oxide reaction products, imidazole surfactants, polyether surfactants, polyamine compounds such as those described in U.S. Pat. No. 3,723,263 and polyoxyethylene compounds such as those described in U.S. Pat. No. 3,855,085.

Illustrative polyvinylpyrrolidones which can be used with the alkyl substituted ammonium propoxylate salts and alkylated naphthalene sulfonic acids or salts thereof in the primary additive component of the present invention can be described by the following structural formula:

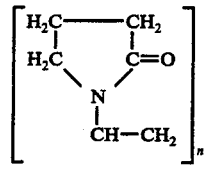

wherein *n* is an integer from about 50 to 500 and preferably from 90 to 150.

Illustrative imidazole surfactants which can likewise be used with the alkyl substituted ammonium propoxylate salts and alkylated naphthalene sulfonic acids or salts thereof in the primary additive component of the present invention include the quaternary imidazolinium compounds of the following general formula:

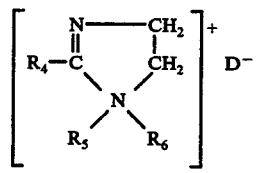

wherein $R_4$ is a saturated or unsaturated fatty acid radical, $R_5$ is an alkyl carboxylate radical or alkali metal carboxylate, $R_6$ is an alkyl alcohol, alkyl alcoholate or ethoxylated alkyl carboxylic acid or alkali metal salt thereof, and D is a hydroxyl ion or long chain sulfate or sulfamate anion.

Illustrative polyether surfactants which can likewise be used with the alkyl substituted ammonium propoxylate salts and alkylated naphthalene sulfonic acids or salts thereof in the primary additive component of the present invention include polyethoxylated alkyl phenols of the formula:

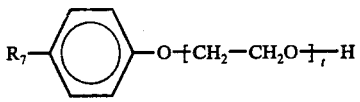

wherein $R_7$ is an alkyl group of 8 to 16 carbon atoms and $t$ is an integer from 5 to 50.

The secondary additives or brighteners which cooperatively function with the carrier component of the present invention generally include the organic brighteners selected from the group aryl ketones, aryl aldehydes, tetrahydro- and ring halogenated aryl ketones and aldehydes, heterocyclic aldehydes and ketones, carbocyclic aldehydes and ketones, and aliphatic aldehydes having four to seven carbon atoms.

Illustrative examples of these secondary additives or brighteners include ortho-chlorobenzaldehyde, para-chlorobenzaldehyde, benzylidene acetone, coumarin, thiophene aldehyde, cinnamic aldehyde, glutaraldehyde, beta-ionone, and 1,2,3,6-tetrahydrobenzaldehyde.

The auxiliary additives which can be effectively utilized in the plating baths of this invention include ethyl hexyl sulfate, ethoxylated alkyl sulfates, the sulfobetaine surfactants and aromatic acid salts and homologs thereof including, in particular, the alkali metal salts of benzoic acid which optionally can be substituted with one or more alkyl, alkenyl, halogen or alkoxy groups on the benzene ring. Exemplary auxiliary additives include sodium benzoate, potassium benzoate, sodium 2-methylbenzoate, sodium 2-methoxybenzoate, sodium 4-chlorobenzoate, sodium 4-methoxybenzoate, sodium 4-ethoxybenzoate, sodium 4-butoxybenzoate, sodium 2,4-diethylbenzoate, sodium 4-hexylbenzoate, sodium 2-allybenzoate, sodium 3-pent-4-enylbenzoate, 3-hydroxy-2-naphthoic acid, and pyridine carboxylic acid (niacin).

In accordance with the present invention, the primary additive or carrier component of the bath composition will generally be present in an amount which will provide a concentration in the mildly acidic electroplating bath of from about 0.5 to about 20 grams per liter and, preferably, in an amount which will provide a bath concentration of from approximately 2 to 10 grams per liter. Typically, the amount of alkyl substituted ammonium propoxylate salt to alkylated naphthalene sulfonate will range from approximately 10:1 to 1:10 with equal concentrations of each being generally preferred for most plating operations. The primary additive or carrier component is generally present in an amount of from 5 to 10 times the amount of secondary additive. Typically, the secondary additive or brightener will be present in an amount which will provide a bath concentration of from 0.05 to about 5 grams per liter and, preferably, an amount which will provide a bath concentration of from about 0.05 to about 1 grams per liter. Correspondingly, the auxiliary additive will be present in an amount which will provide a bath concentration of from about 0.5 to 20 grams per liter and, preferably, in an amount which will provide a bath concentration of from about 1 to about 10 grams per liter.

While the foregoing materials constitute essential ingredients of the zinc electroplating baths of the present invention, additional non-essential additives can be advantageously used in conjunction therewith. For example, other substances which have been found to exhibit secondary brightening action and can therefore be utilized include other surfactants or wetting agents as well as such materials as polyvinyl alcohols, gelatin, carboxymethyl cellulose, animal glue, evaporated milk and the like.

If desired, chelating agents such as, for example, citric acid and maleic acid, can be added to the electroplating baths in systems wherein iron is not present to prevent the precipitation of zinc compounds either in the body of the plating bath or at the surfaces of the cathode or anode. These chelating agents will also serve to provide buffering action in the bath. Such chelating agents will generally be added in amounts of 10 to 100 grams per liter and, preferably, in an amount of from about 50 to 75 grams per liter.

The baths of this invention are mildly acidic, having a pH of from 4.0 to 6.5 and, preferably, a pH of from 5.0 to 5.8. The desired acidity can be readily obtained through the addition of minor amounts of acid or base (e.g. mineral acids such as hydrochloric acid or a base such as ammonium hydroxide). Other buffering agents may be employed if desired to stabilize the pH of the film formed at the cathode and to maintain the pH of the bath within the desired limits. Exemplary buffers are boric acid and acetic acid.

The baths of the present invention can be used to form bright zinc electrodeposits on a workpiece or object having a metallic surface by using the workpiece as a cathode in the bath. Accordingly, a further embodiment of the present invention resides in a method of forming bright zinc electrodeposits which comprises making a workpiece having a metallic surface the cathode in an aqueous bath having a composition as heretofore described.

The metallic surface or base metal onto which the bright zinc deposits of this invention can be applied include ferrous metals such as steel; copper including its alloys such as brass, bronze and the like; die cast metals such as zinc or cast iron; as well as thin coatings such as silver, nickel or copper on a non-conductive article such as rigid or flexible plastic which has been applied by chemical means such as electroless plating.

It will be appreciated that the operating conditions such as temperature and current density under which the plating baths of this invention are employed may vary depending upon the particular bath composition and the nature of the metal surface to be plated. The bright zinc electroplating process may be carried out at temperatures of about 10° C. to 50° C. and preferably between 15° C. and 35° C., either with or without agitation. If necessary, agitation of the plating bath can be provided either by mechanical movement of the article being plated or by solution agitation during the electrodeposition.

The following examples are presented to illustrate the electroplating bath and electroplating methods of the present invention.

EXAMPLE 1

To a freshly prepared aqueous electrolyte solution containing 100 grams per liter of zinc chloride and 170 grams per liter of ammonium chloride and which has been adjusted to pH 5.4 with ammonium hydroxide was added 4 grams per liter of a mixture of sodium mono and dimethyl naphthalene sulfonate, 4 grams per liter of methyl diethyl ammonium propoxylate chloride having a molecular weight of about 600, and 4 grams per liter of sodium benzoate. The electrolyte bath was charged into a standard Hull Cell utilizing steel panels and subjected to 2 amperes of current, without agitation, for a period of 5 minutes at a temperature of 75° F. The deposit on the steel panel was found to be streaky semi-bright along the high current density edge to about 120 amperes per square foot (ASF); semi-bright and uniform from about 120 ASF to about 30 ASF; and bright and uniform from about 30 ASF to the low current density edge with coverage to the back of the panel.

EXAMPLE 2

To an aqueous electrolyte solution containing 100 grams per liter of zinc chloride and 170 grams per liter of ammonium chloride and which was adjusted to a pH of 5.4 with ammonium hydroxide was added 4 grams per liter of a mixture of sodium mono and dimethyl naphthalene sulfonate, 4 grams per liter of methyl diethyl ammonium propoxylate chloride having a molecular weight of about 600, 4 grams per liter of sodium benzoate and 0.1 gram per liter of o-chloro benzaldehyde dissolved at a 10 percent by weight concentration in isopropyl alcohol. The plating bath was placed into a standard Hull Cell utilizing steel panels and was subjected to 2 amperes of current, without agitation, for a period of 5 minutes at a temperature of 75° F. The deposit on the steel panel was found to be streaky brilliant from the high current density edge to about 80 ASF, brilliant and uniform from about 80 ASF to 1 ASF, and bright and uniform from about 1 ASF to the low current density edge. The cathode efficiency was noted as being high by the lack of significant gassing except at the very high current density area.

EXAMPLE 3

The plating bath prepared and used in Example 2 was stored for a period of about 24 hours with the anode remaining immersed. After this time, another steel panel was plated under the same conditions utilized in Example 2. The appearance of the electroplated deposit was found to be identical to that of the first used panel demonstrating exceptional bath stability.

The composition of additional zinc electroplating baths of this invention are shown in the following examples. The following compositions further illustrate the present invention but are not to be construed as limiting the scope thereof.

EXAMPLE 4

| | |
|---|---|
| Zinc chloride | 100 g/l |
| Ammonium chloride | 170 g/l |
| Sodium benzoate | 5 g/l |
| Condensation reaction product of sodium alkyl naphthalene sulfonate and formaldehyde (Daxad 11) | 2.5 g/l |
| Sodium mono and dimethyl napthalene sulfonate | 10 g/l |
| Polyoxyethylene sulfate ester (Alipal CD-128; GAF Corp.) | 5 g/l |
| Methyl diethyl ammonium propoxylate chloride M.W. 600 | 10 g/l |

EXAMPLE 4-continued

| | |
|---|---|
| Ammonium hydroxide to give pH 5.5 | |

EXAMPLE 5

| | |
|---|---|
| Zinc chloride | 100 g/l |
| Ammonium chloride | 200 g/l |
| Sodium benzoate | 2 g/l |
| Ethyl hexyl sulfate | 20 g/l |
| Sodium mono and dimethyl napthalene sulfonate | 10 g/l |
| Methyl diethyl ammonium propxylate chloride M.W. 600 | 10 g/l |
| Ammonium hydroxide to give pH 4.0 | |

EXAMPLE 6

| | |
|---|---|
| Zinc sulfate | 20 g/l |
| Ammonium chloride | 100 g/l |
| Sodium 4-methylbenzoate | 1 g/l |
| Reaction product of nonyl phenol and 15 moles of ethylene oxide | 0.5 g/l |
| Sodium mono and dimethyl naphthalene sulfonate | 1 g/l |
| Methyl diethyl ammonium propoxylate chloride M.W. 2500 | 1 g/l |
| Ammonium hydroxide to give pH 5.0 | |

EXAMPLE 7

| | |
|---|---|
| Zinc chloride | 85 g/l |
| Ammonium chloride | 120 g/l |
| Potassium 2-methoxybenzoate | 10 g/l |
| Naphthalene sulfonate and formaldehyde condensation reaction product | 1 g/l |
| Sodium mono and dimethyl naphthalene sulfonate | 4 g/l |
| Methyl diethyl ammonium propoxylate chloride M.W. 600 | 14 g/l |
| Ammonium hydroxide to give pH 6.5 | |

EXAMPLE 8

| | |
|---|---|
| Zinc chloride | 80 g/l |
| Ammonium chloride | 200 g/l |
| Sodium 4-butylbenzoate | 0.5 g/l |
| Quaternary imidazolinium compound (miranol C 2 M-SE Miranol Corp. Irvington, N.J.) | 1 g/l |
| Methyl phenyl ketone | 0.5 g/l |
| Benzophenone | 0.5 g/l |
| Sodium mono and dimethyl naphthalene sulfonate | 7 g/l |
| Methyl diethyl ammonium propoxylate M.W. 600 | 7 g/l |
| Ammonium hydroxide to give pH 5.5 | |

EXAMPLE 9

| | |
|---|---|
| Zinc chloride | 75 g/l |
| Ammonium chloride | 150 g/l |
| Sodium benzoate | 5 g/l |
| Sulfobetaine surfactant | 4 g/l |
| Sodium mono and dimethyl naphthalene sulfonate | 10 g/l |
| Methyl diethyl ammonium propoxylate M.W. 600 | 10 g/l |
| Benzylidene acetone | 0.5 g/l |
| Ammonium hydroxide to give pH 5.8 | |

The compositions of Examples 4–9 can be utilized to produce ductile, fine grained, adherent deposits over a broad current density range. As such, these examples as well as Examples 1–3 illustrate that the use in an acid zinc electroplating bath of a primary additive or carrier which includes a trialkylammonium propoxylate salt and alkylated naphthalene sulfonic acids or water soluble salts thereof in conjunction with other brighteners and grain refiners in accordance with the present invention provides a bath which possesses good throwing power and cathode efficiency, can be used over wide operating conditions and which provides zinc electrodeposits which are bright, ductile and exhibit fine grain structure.

I claim:

1. An aqueous bath for producing a bright zinc electroplated deposit having a pH of from 4.0 to 6.5 and including from 20 to 100 grams per liter of zinc salt; from 100 to 200 grams per liter of ammonium chloride; from about 0.5 to about 20 grams per liter of a primary additive component, from about 0.05 to about 5.0 grams per liter of a brightening agent, and from about 0.5 to about 20 grams per liter of an auxiliary additive component, said primary additive component comprising a mixture of a cationic quaternary ammonium surfactant of the formula

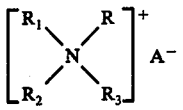

wherein R, $R_1$ and $R_3$ are lower alkyl radicals, $R_2$ is a polyoxypropylene radical and A is selected from the group consisting of halogen, sulfate and sulfamate, said ammonium surfactant having a molecular weight of from 500 to 3000 together with a lower alkyl substituted naphthalene sulfonic acid or water soluble salt thereof wherein the alkyl groups contain from 1 to 4 carbon atoms, the amount of cationic quaternary ammonium surfactant to alkylated naphthalene sulfonic acid or water soluble salt thereof ranging from about 10:1 to 1:10 parts by weight.

2. The aqueous bath of claim 1 wherein R is methyl, $R_1$ and $R_3$ are each ethyl, $R_2$ is a polyoxypropylene radical and A is selected from the group consisting of halogen, sulfate and sulfamate.

3. The aqueous bath of claim 1 wherein said alkylated naphthalene sulfonic acids and water soluble salts thereof are mono and dialkyl substituted and said alkyl groups contain 1 or 2 carbon atoms.

4. The aqueous bath of claim 1 wherein said alkylated naphthalene sulfonate is selected from the group alkali metal mono and dimethyl naphthalene sulfonate.

5. The aqueous bath of claim 4 wherein said alkylated naphthalene sulfonate is sodium methyl naphthalene sulfonate.

6. The aqueous bath of claim 4 wherein said alkylated naphthalene sulfonate is sodium dimethyl naphthalene sulfonate.

7. The aqueous bath of claim 1 wherein the amount of cationic quaternary ammonium surfactant to alkylated naphthalene sulfonic acid or water soluble salt is about 1 to 1 parts by weight.

8. The aqueous bath of claim 1 wherein said primary additive component is present in an amount of from about 2 to about 10 grams per liter.

9. The aqueous bath of claim 1 wherein said cationic quaternary surfactant is present in said bath in an amount of from about 0.5 to about 10 grams per liter and said alkylated naphthalene sulfonic acid or water soluble salt thereof is present in an amount of from 0.5 to about 10 grams per liter.

10. The bath of claim 1 wherein said brightening agent is selected from the group consisting of aryl ketones, aryl aldehydes, tetrahydro- and ring halogenated aryl ketones and aldehydes, heterocyclic aldehydes and ketones, carbocyclic aldehydes and ketones, and aliphatic aldehydes having four to seven carbon atoms.

11. The bath of claim 1 wherein said brightening agent is selected from the group ortho-chlorobenzaldehyde, parachlorobenzaldehyde, benzylidene acetone, coumarin, thiophene aldehyde, cinnamic aldehyde, glutaraldehyde, beta-ionone, and 1,2,3,6-tetrahydrobenzaldehyde.

12. The bath of claim 1 wherein said auxiliary additive component is selected from the group ethyl hexyl sulfate, ethoxylated alkyl sulfates, the sulfobetaine surfactants and aromatic acid salts and homologs thereof.

13. The bath of claim 1 wherein said auxiliary additive component is selected from the group consisting of sodium benzoate, potassium benzoate, sodium 2-methylbenzoate, sodium 2-methoxybenzoate, sodium 4-chlorobenzoate, sodium 4-methoxybenzoate, sodium 4-ethoxybenzoate, sodium 4-butoxybenzoate, sodium 2,4-diethylbenzoate, sodium 4-hexylbenzoate, sodium 2-allylbenzoate, sodium 3pent-4-enylbenzoate, 3-hydroxy-2-naphthoic acid, and pyridine carboxylic acid.

14. A method of forming bright zinc electrodeposits which comprises making a workpiece having a metallic surface the cathode in the aqueous bath of claim 1.

* * * * *